US007831166B2

(12) United States Patent
Hirano

(10) Patent No.: US 7,831,166 B2
(45) **Date of Patent: *Nov. 9, 2010**

(54) IMAGE FORMING APPARATUS AND CONTROL METHOD FOR THE SAME

(75) Inventor: Yoshiharu Hirano, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 112 days.

This patent is subject to a terminal disclaimer.

(21) Appl. No.: 12/179,748

(22) Filed: Jul. 25, 2008

(65) Prior Publication Data

US 2008/0285089 A1 Nov. 20, 2008

Related U.S. Application Data

(63) Continuation of application No. 11/822,461, filed on Jul. 6, 2007, now Pat. No. 7,415,217, which is a continuation of application No. 11/495,529, filed on Jul. 31, 2006, now Pat. No. 7,254,354, which is a continuation of application No. 10/872,473, filed on Jun. 22, 2004, now Pat. No. 7,113,720.

(30) Foreign Application Priority Data

Jul. 8, 2003 (JP) ..... 2003-193852

(51) Int. Cl.
*G03G 15/00* (2006.01)
*G03G 21/02* (2006.01)

(52) U.S. Cl. ..... 399/80; 399/79

(58) Field of Classification Search ..... 399/79, 399/80

See application file for complete search history.

(56) References Cited

U.S. PATENT DOCUMENTS

| | | | | |
|---|---|---|---|---|
| 5,694,222 | A | 12/1997 | Yamada | |
| 5,708,709 | A | 1/1998 | Rose | |
| 5,999,766 | A | 12/1999 | Hisatomi et al. | |
| 6,026,258 | A | 2/2000 | Fresk et al. | |
| 6,216,183 | B1 | 4/2001 | Rawlins | |
| 6,385,675 | B1 | 5/2002 | Yamaguchi | |
| 6,498,912 | B1 | 12/2002 | Leni et al. | |
| 6,574,443 | B1 | 6/2003 | Butikofer et al. | |
| 6,903,840 | B1 | 6/2005 | Maymin et al. | |
| 7,113,720 | B2 | 9/2006 | Hirano | |
| 7,254,354 | B2 | 8/2007 | Hirano | |
| 7,415,217 | B2 * | 8/2008 | Hirano | 399/80 |
| 2003/0131251 | A1 | 7/2003 | Fetkovich | |

FOREIGN PATENT DOCUMENTS

| | | | |
|---|---|---|---|
| JP | 2001-34469 | A | 2/2001 |
| JP | 2002-366245 | A | 12/2002 |

* cited by examiner

*Primary Examiner*—Sandra L Brase
(74) *Attorney, Agent, or Firm*—Foley & Lardner LLP

(57) ABSTRACT

For a network printer function and a network scan function, a trial using mode whose use frequency is limited can be set. When the preset trial using mode is finished, the use of the tried function is permitted according to setting of an exclusive key.

15 Claims, 4 Drawing Sheets

IMAGE FORMING APPARATUS AND CONTROL METHOD FOR THE SAME

CROSS-REFERENCE TO RELATED APPLICATIONS

The present application is a continuation based upon U.S. application Ser. No. 11/822,461, filed Jul. 6, 2007, which is a continuation of U.S. application Ser. No. 11/495,529, filed Jul. 31, 2006, which is a continuation of U.S. application Ser. No. 10/872,473, filed Jun. 22, 2004, which claims the benefit of priority from the prior Japanese Patent Application No. 2003-193852 filed on Jul. 8, 2003; the entire contents of which are incorporated herein by reference.

BACKGROUND OF THE INVENTION

1. Field of the Invention

The present invention relates to a composite image forming apparatus having a plurality of functions such as a copying function, a network scanner function, and a network printer function and a control method therefor.

2. Description of the Related Art

There is a composite image forming apparatus having a plurality of functions such as, in addition to the regular copying function, the network scanner function for externally transmitting an image read by a scanner by attaching it to an electronic mail and the network printer function for printing and outputting an image according to an image signal input externally.

In such a composite image forming apparatus, the copying function can be used immediately as a standard function. However, the network scanner function and network printer function may be permitted to use them under the condition that a user optionally purchases them when necessary.

However, even if the user optionally purchases the network scanner function or network printer function, thereafter he has few chances to use it, thus he may be required for useless expenses.

SUMMARY OF THE INVENTION

An object of the present invention is to provide an image forming apparatus giving superior services such that a user can use one or a plurality of functions on trial and can optionally decide optional purchase of a desired function on the basis of the use and a control method therefor.

According to the present invention, an image forming apparatus having a plurality of functions is provided and the image forming apparatus comprises setting means for setting a trial using mode for limiting a use frequency or use days of at least one function among the plurality of functions; and control means, when the preset trial using mode reaches the limited use frequency or the use days or when the trial using mode is interrupted during the limited use frequency or the use days, for permitting subsequent use of the tried function according to setting of an exclusive key.

Furthermore, according to the present invention, a control method for an image forming apparatus having a plurality of functions is provided and the control method comprises setting a trial using mode for limiting a use frequency or use days of at least one function among the plurality of functions; and permitting subsequent use of the tried function according to an exclusive key when the preset trial using mode reaches the limited use frequency or the use days or when the trial using mode is interrupted during the limited use frequency or the use days.

DETAILED DESCRIPTION OF THE INVENTION

Figure 1:
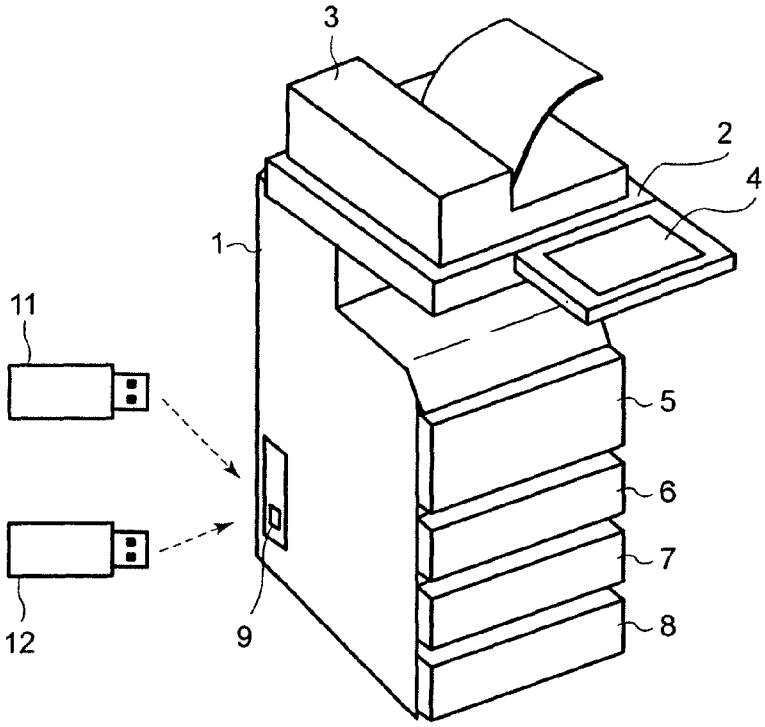
FIG. 1 is a perspective view showing an embodiment of the image forming apparatus of the present invention.
Figure 2:
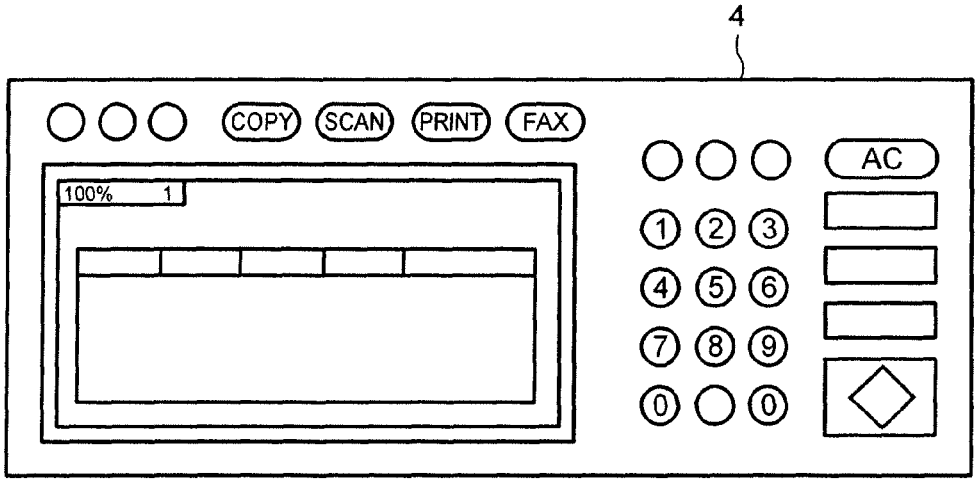
FIG. 2 is a plan view schematically showing the constitution of the control panel of the image forming apparatus shown in FIG. 1.

An embodiment of the present invention will be explained below with reference to the accompanying drawings. As shown in FIG. 1, on the top of main body 1 of the image forming apparatus, document table 2 is installed. On document table 2, automatic document feeder 3 including an ejection tray is installed so as to be freely opened or closed. In the position at the same height as that of document table 2, control panel 4 shown in FIG. 2 is installed as an operation means for setting operation conditions.

On the lower part of main body 1, paper supply cassettes 5 to 8 storing papers of various sizes which are image forming media are installed.

On the side of main body 1, USB interface 9 for inserting and connecting print enable key 11 or scan enable key 12 is installed. Print enable key 11 and scan enable key 12 are an exclusive key given from a manufacturer or a sales agency to permit use of a function tried. Each exclusive key has a built-in memory storing the use-permitted code. Each exclusive key may be a password given from the manufacturer or sales agency. In this case, when the password is input from control panel 4, the tried function is permitted to be used.

Figure 3:
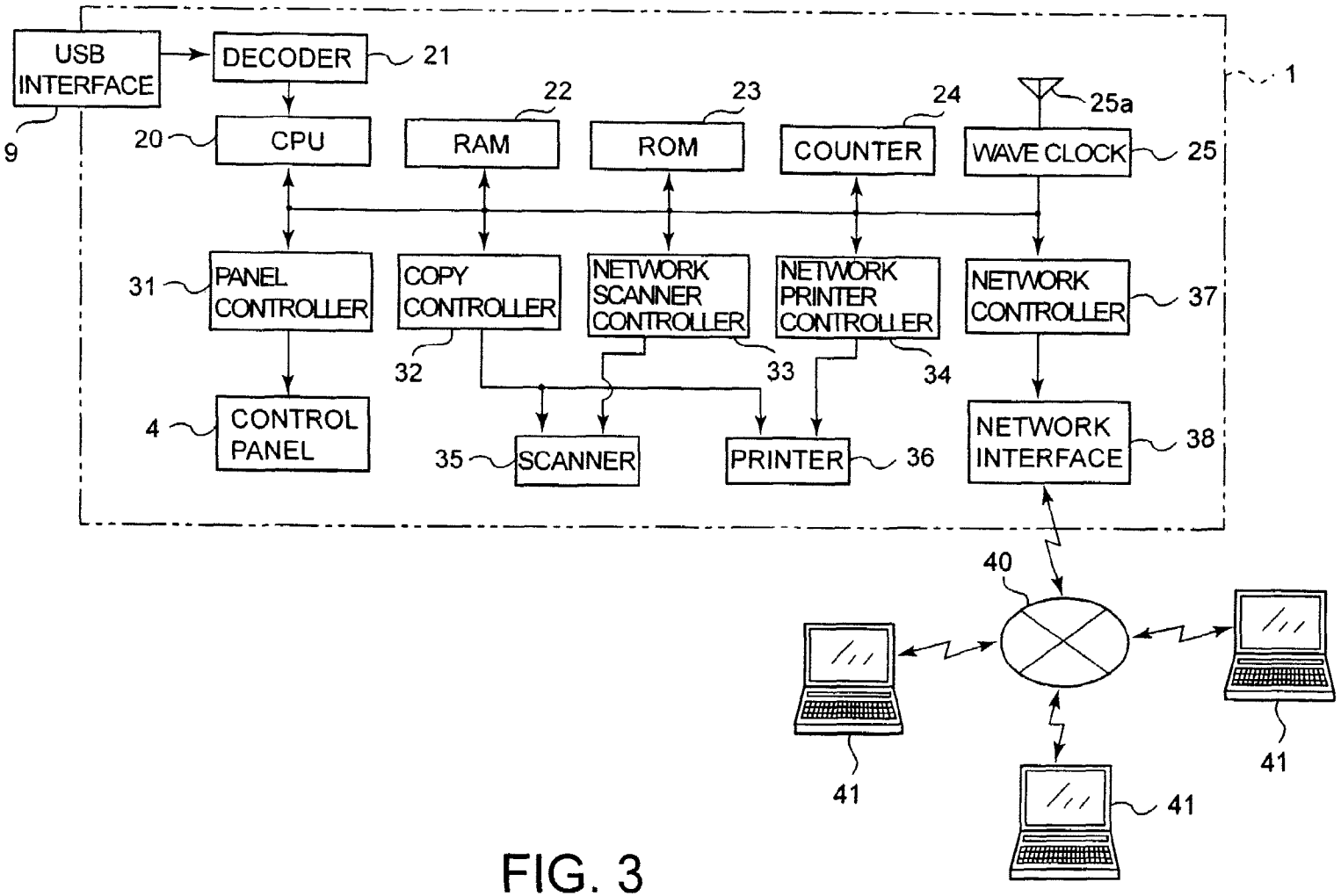
FIG. 3 is a block diagram showing the control circuit of the image forming apparatus shown in FIG. 1.

FIG. 3 shows the control circuit inside main body 1.

Reference numeral 20 indicates a CPU which is a center of control and to CPU 20, decoder 21, RAM 22, ROM 23, counter 24, wave clock 25, panel controller 31, copy controller 32, network scanner controller 33, network printer controller 34, and network controller 37.

Decoder 21 reads a code from print enable key 11 or scan enable key 12 inserted and connected to USB interface 9 and decodes the code. The decoded results are supplied to CPU 20. RAM 22 stores decoding data for the aforementioned code, preset value N for printing number of times P which will be described later, and preset value S for scanning number of times L which will be described later. ROM 23 stores various kinds of control programs necessary for the operation of main body 1. Counter 24 counts printing number of times P and scanning number of times L in the trial using mode. Wave clock 25 is equipped with antenna 25*a*, measures the present time, and successively updates the present time by receiving a standard time wave.

Panel controller 31 controls control panel 4. Copy controller 32 controls the copy function using scanner 35 and printer 36. Network scanner controller 33 controls the network scanner function using scanner 35. Network printer controller 34 controls the network printer function (the FAX function included) using printer 36. Network controller 37 controls data transmission and reception from the outside via network interface 38.

Network interface 38 includes a LAN board and a FAX modem and is connected to many personal computers 41 which are user terminals via external communication line 40.

CPU 20 has the next means (1) and (2) as main functions.

(1) A setting means for setting a trial using mode for limiting the trial frequency (or use days) of at least one function among the network scanner function and network printer function.

(2) A control means, during or after end of the preset trial using mode, for permitting the subsequent use of the function tried according to the setting (insertion and connection) of print enable key 11 or scan enable key 12.

Figure 4:
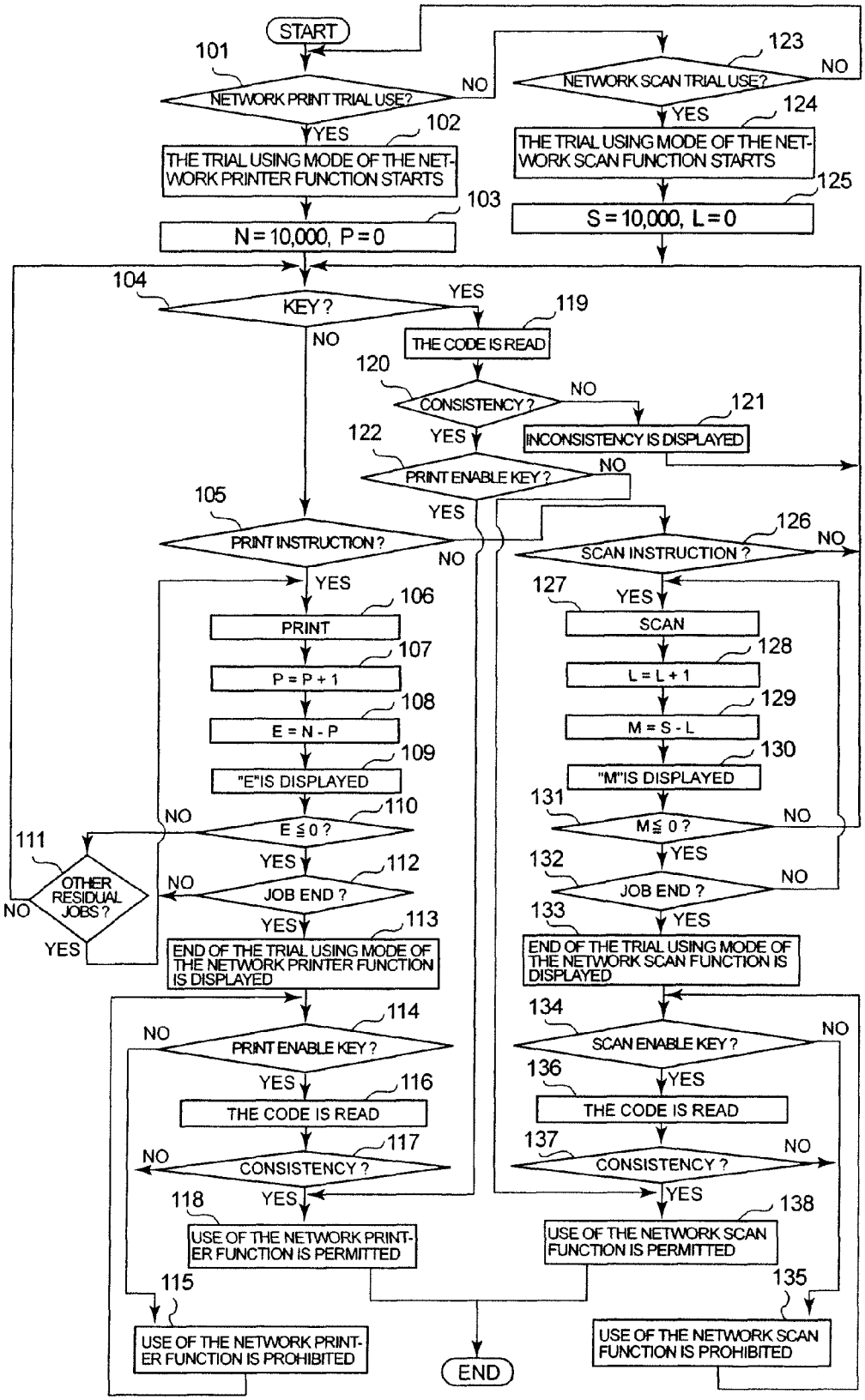
FIG. 4 is a flow chart for explaining the operation of the image forming apparatus shown in FIG. 1.

Next, the operation of the aforementioned constitution will be explained by referring to the flow chart shown in FIG. 4.

When main body 1 is installed and then a request for network print trial is input from control panel 4 (YES at Step 101), the trial using mode of the network printer function is started in main body 1 according to the input (Step 102). The request for network print trial is received by operation of a serviceman present at the installation. And, trial preset value N of the network printer function is set to, for example, 10,000 sheets and printing number of times P of counter 24 is initialized to 0 (Step 103).

Figure 5:
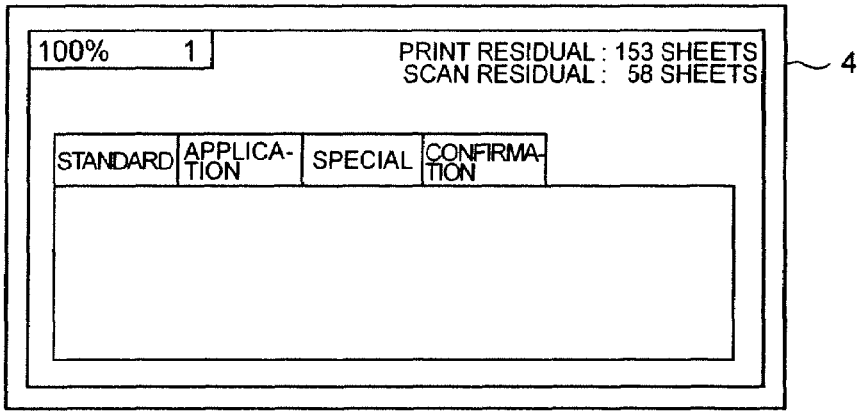
FIG. 5 is a plan view showing a display example of the control panel shown in FIG. 2.

When in the state that print enable key 11 is not set (NO at Step 104), a print instruction is input to main body 1 from personal computer 41 via communication line 40 (YES at Step 105), a print operation according to an image signal input from personal computer 41 is executed by printer 36 (YES at Step 106). In correspondence with this print operation, printing number of times P of counter 24 is incremented by 1 (Step 107), and printing number of times P after increment of 1 is subtracted from trial preset value N, and residual trial preset value E is obtained (Step 108). Obtained residual trial preset value E, as shown in FIG. 5, is displayed in characters in the display area of control panel 4 as "Print residual: . . . sheets" (Step 109). When the user looks at the display, he can confirm residual preset value E of trial network print.

Before residual trial preset value E becomes 0 (NO at Step 110), if in the print instruction, there are a plurality of print jobs, until all the print jobs are finished (YES at Step 111), the processes from Step 106 to Step 109 are repeated.

Even if residual trial preset value E becomes 0 (YES at Step 110), when all the print jobs are not finished (NO at Step 112), the processes from Step 106 to Step 109 are repeated.

Figure 6:
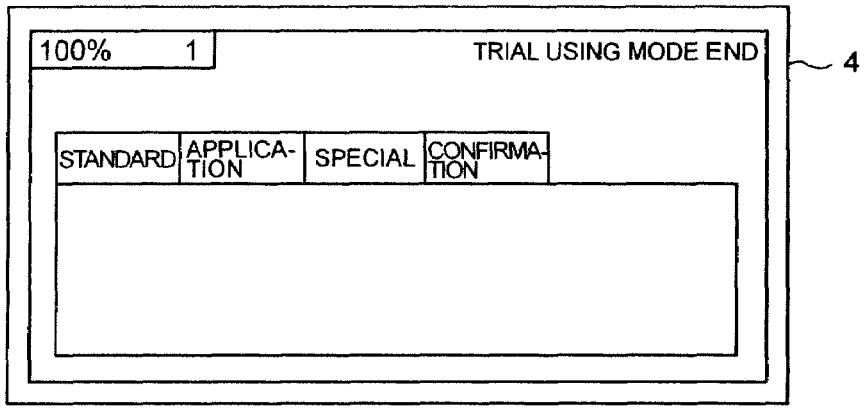
FIG. 6 is a plan view showing another display example of the control panel shown in FIG. 2.

When residual trial preset value E becomes 0 or less (YES at Step 110) and all the print jobs are finished (YES at Step 112), the trial using mode of the network print function is finished. By doing this, as shown in FIG. 6, in the display area of control panel 4, the characters of "Trial using mode end" are displayed (Step 113).

After end of the trial using mode of the network printer function, if print enable key 11 is not inserted and connected to USB interface 9 (NO at Step 114), the use of the network printer function is prohibited as it is (Step 115).

After end of the trial using mode of the network printer function, a user desiring use of the network printer function is given print enable key 11 from a store. In print enable key 11, an identification code intrinsic to main body 1 is stored together with a printable code as a condition for permitting use. When print enable key 11 is inserted and connected to USB interface 9 (YES at Step 114), a code is read from print enable key 11 and the read code is decoded (Step 116). When the decoded result coincides with the identification code intrinsic to the main body 1 and the printable code (YES at Step 117), the subsequent use of the network printer function is permitted (Step 118).

During the trial using mode of the network printer function, print enable key 11 may be inserted and connected to USB interface 9 (YES at Step 104). In this case, a code is read from print enable key 11 and the read code is decoded (Step 119). When the decoded result does not coincide with the identification code intrinsic to the main body 1 and the printable code (NO at Step 120), the effect of inconsistency is displayed in the display area of control panel 4 (Step 121). The user looking at this display requests to exchange print enable key 11 to a proper one and inserts and connects a new one again to USB interface 9 (YES at Step 104).

A code is read and decoded from reset print enable key 11 (Step 119) and when the decoded result coincides with the identification code intrinsic to main body 1 and the printable code (YES at Step 120), since print enable key 11 is reset (YES at Step 122), the subsequent use of the network printer function is permitted (Step 118).

When main body 1 is installed and then a request for network scan trial is input from control panel 4 (YES at Step 123), the trial using mode of the network scan function is started in main body 1 according to the input (Step 124). The request for network scan trial is also received by operation of a serviceman present at the installation. And, trial preset value S of the network scan function is set to, for example, 10000 sheets and scanning number of times L of counter 24 is initialized to 0 (Step 125).

When in the state that scan enable key 12 is not set (NO at Step 104), a scan instruction is input from main body 1 (YES at Step 126), a scan operation is executed by scanner 35 according to an operation from main body 1 of the image forming apparatus (Step 127). In correspondence with this scan operation, scanning number of times L of counter 24 is incremented by 1 (Step 128), and scanning number of times L after increment of 1 is subtracted from trial preset value S, and residual trial preset value M is obtained (Step 129). Obtained residual trial preset value M, as shown in FIG. 5, is displayed in the display area of control panel 4 as "Scan residual: . . . sheets" (Step 130). When the user looks at the display, he can confirm residual preset value M of trial network scan.

Before residual trial preset value M becomes "0" (NO at Step 131), if in the scan instruction, there are a plurality of scan jobs, until all the scan jobs are finished (YES at Step 132), the processes from Step 127 to Step 130 are repeated.

Even if residual trial preset value M becomes 0 (YES at Step 131), when all the scan jobs are not finished (NO at Step 132), the processes from Step 127 to Step 130 are repeated.

When residual trial preset value M becomes 0 or less (YES at Step 131) and all the scan jobs are finished (YES at Step 112), the trial using mode of the network print function is finished. By doing this, as shown in FIG. 6, in the display area of control panel 4, the characters of "Trial using mode end" are displayed (Step 133).

After end of the trial using mode of the network printer function, if scan enable key 12 is not inserted and connected to USB interface 9 (NO at Step 134), the use of the network scan function is prohibited as it is (Step 135).

After end of the trial using mode of the network scan function, a user desiring use of the network scan function is given scan enable key 12 from a store. In scan enable key 12, an identification code intrinsic to main body 1 is stored together with a scannable code as a condition for permitting use.

When scan enable key 12 is inserted and connected to USB interface 9 (YES at Step 134), a code is read from scan enable key 12 and the read code is decoded (Step 136). When the decoded result coincides with the identification code intrinsic to the main body 1 and the scannable code (YES at Step 137), the subsequent use of the network scan function is permitted (Step 138).

During the trial using mode of the network scan function, scan enable key 12 may be inserted and connected to USB interface 9 (YES at Step 104). In this case, a code is read from scan enable key 12 and the read code is decoded (Step 119). When the decoded result does not coincide with the identification code intrinsic to the main body 1 and the scannable code (NO at Step 120), the effect of inconsistency is displayed in the display area of control panel 4 (Step 121). The user looking at this display requests to exchange scan enable key 12 to a proper one and inserts and connects a new one again to USB interface 9 (YES at Step 104).

A code is read and decoded from reset scan enable key 12 (Step 119) and when the decoded result coincides with the identification code intrinsic to main body 1 and the printable code (YES at Step 120), since scan enable key 12 is reset (NO at Step 122), the subsequent use of the network scan function is permitted (Step 138).

As explained above, the image forming apparatus has, in addition to the copy function which can be used regularly, the network print function and network scan function and a user can use these functions on trial. By doing this, he can sufficiently recognize by his own experience whether the respective functions are necessary or not. As a result, only when the user desires to optionally purchase his desired function, print enable key 11 or scan enable key 12 for permitting use of the function is given, so that efficient business free of disadvantage can be executed by a store or a manufacturer supplying main body 1. For the user, the present invention is economical because he does not need to pay a rental fee of a useless function which is not used.

Figure 7:
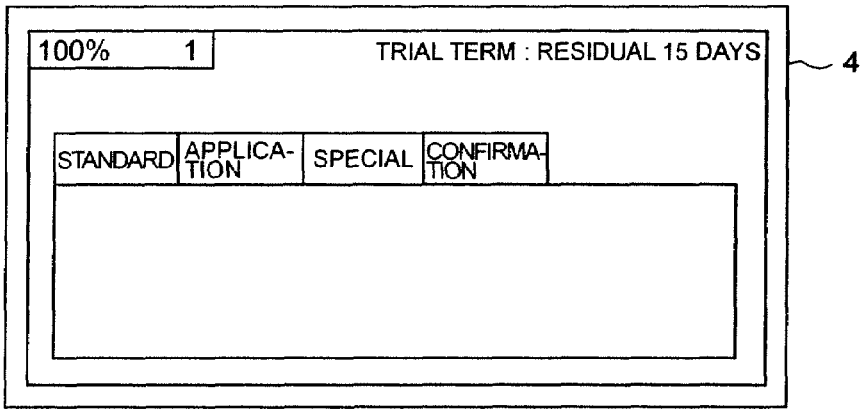
FIG. 7 is a plan view showing still another display example of the control panel shown in FIG. 2.

Further, in the aforementioned embodiment, as a limit to the trial using mode, residual trial printing number of times P or M is decided. However, simultaneously with first print and first scan, time count by measurement of the wave clock is started and the elapsed days on the basis of the time count may be decided as a limit to the trial using mode. In this case, as shown in FIG. 7, in the display area of control panel 4, "Trial term: residual . . . days" is displayed.

Further, in the aforementioned embodiment, the exclusive key having a built-in memory storing a use-permitted code is described. However, it may be a password given from a manufacturer or a sales agent. In this case, when this password is input from control panel 4, the use of the function tried is permitted.

The present invention is not limited to the aforementioned embodiment itself and in the execution stage, as long as the objects of the present invention are accomplished, the components may be modified and materialized. Further, by a proper combination of a plurality of components disclosed in the aforementioned embodiment, various inventions can be formed. For example, from all the components shown in the embodiment, some components may be deleted. Furthermore, components included indifferent embodiments may be properly combined.

As mentioned above, according to the present invention, a plurality of functions can be used on trial by a user and an image forming apparatus realizing superior services such that a user can decide to optionally purchase his desired function on the basis of the use and a control method for it can be provided.

What is claimed is:

1. A control method for an image forming apparatus having a plurality of functions, comprising:

setting a trial using mode for limiting a period of use of a network scan function among the plurality of functions;

executing a scan operation according to an operation from a main body of the image forming apparatus when a scan instruction is input to the main body in the state that a scan enable key is not set;

finishing the trial using mode of the network scan function when elapsed days reach the limited period of use in correspondence with the scan operation;

judging whether the scan enable key is set or not; and permitting subsequent use of the network scan function when it is judged that the scan enable key is set after end of the trial using mode and a code read from the scan enable key coincides with an identification intrinsic code.

2. The control method according to claim 1, wherein the setting step sets a request for trial use to a start condition for the trial using mode.

3. The control method according to claim 1, wherein the scan enable key includes a use-permitted password and the permitting step, when the password is input, permits subsequent use of the tried network scan function.

4. The control method according to claim 1, wherein the scan enable key is a USB type and in which a use-permitted code is stored.

5. The control method according to claim 1, wherein the image forming apparatus has a control panel to display a residual days from the limited period of use.

6. An image forming apparatus having a plurality of functions, comprising:

means for setting a trial using mode for limiting a period of use of a network scan function among the plurality of functions;

means for executing a scan operation according to an operation from a main body of the image forming apparatus when a scan instruction is input to the main body in the state that a scan enable key is not set;

means for finishing the trial using mode of the network scan function when elapsed days reach the limited period of use in correspondence with the scan operation;

means for judging whether the scan enable key is set or not; and means for permitting subsequent use of the network scan function when it is judged that the scan enable key is set after end of the trial using mode and a code read from the scan enable key coincides with an identification intrinsic code.

7. The apparatus according to claim 6, wherein the setting means sets a request for trial use to a start condition for the trial using mode.

8. The apparatus according to claim 6, wherein the scan enable key includes a use-permitted password and the permitting means, when the password is input, permits subsequent use of the tried network scan function.

9. The apparatus according to claim 6, wherein the scan enable key is a USB type and in which a use-permitted code is stored.

10. The apparatus according to claim 6 further comprising:

means for displaying a residual days from the limited period of use.

11. An image forming apparatus having a plurality of functions, comprising:

a control panel configured to set a trial using mode for limiting a period of use of a network scan function among the plurality of functions;

a scanner configured to scan operation according to an operation from a main body of the image forming apparatus when a scan instruction is input to the main body in the state that a scan enable key is not set;

a controller configured to finish the trial using mode of the network scan function when elapsed days reach the limited period of use in correspondence with the scan operation, to judge whether the scan enable key is set or not, and to permit subsequent use of the network scan function when it is judged that the scan enable key is set after end of the trial using mode and a code read from the scan enable key coincides with an identification intrinsic code.

12. The apparatus according to claim 11, wherein the controller controls the control panel to set a request for trial use to a start condition for the trial using mode.

13. The apparatus according to claim 11, wherein the scan enable key includes a use-permitted password to permit subsequent use of the network scan function when the password is input.

14. The apparatus according to claim 11, wherein the scan enable key is a USB type and in which a use-permitted code is stored.

15. The apparatus according to claim 11 further comprising:

a display configured to display residual days from the limited period of use.

* * * * *